US006722451B2

(12) United States Patent
Saugier

(10) Patent No.: US 6,722,451 B2
(45) Date of Patent: Apr. 20, 2004

(54) CASING WHILE DRILLING

(75) Inventor: Kent Saugier, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/016,786

(22) Filed: Dec. 10, 2001

(65) Prior Publication Data

US 2003/0106688 A1 Jun. 12, 2003

(51) Int. Cl.[7] ..... E21B 3/00

(52) U.S. Cl. ..... 175/57; 166/207; 166/384; 175/171

(58) Field of Search ..... 175/171, 257, 175/113, 101, 92, 320, 89, 57, 61; 166/206, 207, 212, 384

(56) References Cited

U.S. PATENT DOCUMENTS 4,739,843 A * 4/1988 Burton ..... 175/61
5,641,021 A 6/1997 Murray et al. ..... 166/291
6,098,710 A 8/2000 Rhein-Knudsen et al. .. 166/285
6,156,809 A 12/2000 Clark et al. ..... 518/719
6,253,850 B1 * 7/2001 Nazzai et al. ..... 166/207
6,371,203 B2 * 4/2002 Frank et al. ..... 166/207
6,431,282 B1 * 8/2002 Bosma et al. ..... 166/207

* cited by examiner

*Primary Examiner*—David Bagnell
*Assistant Examiner*—Matthew J Smith
(74) *Attorney, Agent, or Firm*—Conley Rose, P.C.

(57) ABSTRACT

A method to deliver an expandable casing string to an uncased borehole coaxially upon a composite coiled tubing drilling string is presented. Once the drilling operation is completed, the casing string is expanded by supplying pressure between the coaxially positioned strings to expand the casing string to the borehole. Preferably, the outer diameter of the casing string contains an adhesive agent designed to be activated by the expansion of the casing string against the borehole wall. Alternatively, the mechanical structure of the casing string itself may be configured to prevent the casing string from collapsing once it has been expanded. Once expanded, the casing string is left behind to isolate the well formation from drilling and production fluids that may subsequently flow therethrough.

9 Claims, 6 Drawing Sheets

CASING WHILE DRILLING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention generally relates to a method for casing wellbores drilled within the earth. More particularly, the present invention relates to a method for casing wellbores drilled within the earth by a composite coiled tubing drilling apparatus. More particularly still, the present invention relates to a method for drilling and casing a wellbore with a composite coiled tubing drilling system in a single trip downhole.

2. Background of the Invention

Traditional drilling rigs include large structures that are erected upon land or offshore. The rigs typically support each length of drill string as it is fed into the well and provide rotational motion to a drill bit at the end of the string of drill pipe. Often, when starting a new well, a large diameter drill bit is used for the first several hundred feet of borehole. Once this borehole is complete, the bit is retrieved and a string of metal pipe, known as casing, is placed in the newly drilled borehole. The casing string is slightly smaller in outer diameter than the drilled borehole. Once in the well, the casing is cemented in place and provides a well-defined and fixed reference for subsequent drilling operations. With the first section of casing string installed, a smaller drill bit is lowered through it and is used to drill another, narrower borehole for the next section of casing string to be installed. As each borehole section is drilled, the gage of the drill bit and diameter of the subsequent casing string are reduced until the entire string of casing resembles an extended, inverted telescope. These lengths of casing serve to isolate the drilling and production fluids from the formation surrounding the casing, thereby preventing loss of these fluids into the formation, cross-contamination of the drilling fluids and formation fluids, and degradation of the surrounding formation.

Recent developments in drilling technology have led to the replacement of conventional drill pipe, which is assembled from relatively short lenghts of rigid pipe, with coiled tubing, which is a single length of flexible pipe, typically of steel or a composite. Systems of this type have the ability to operate without conventional pipe-handling equipment, and are capable of drilling much deeper into the earth's crust and with much more directional capability than was previously achievable. In a composite tubing drilling system, a drilling apparatus is deployed downhole at the end of a long string of composite tubing or hose, the hose being deployed from a large spool on a specialty rig or truck located at the surface. Because no kelly or rotary table is used, all of the mechanical energy to rotate an attached drill bit is created downhole by a downhole drilling motor, with a tractor device being used to maintain the proper amount of weight on bit and torque. As the density of the tubing can be adjusted during manufacture to allow the string to be buoyant in the column drilling fluid, the maximum depth achievable with a drilling system of this type is not limited by the tensile strength of the tubing. Furthermore, because of the relative short tool length and increased flexibility of the composite tubing compared to conventional drill pipe systems, the drilling apparatus is capable of making directional changes with much smaller turning radii than are achievable with rigid drill strings. Additionally, because the composite tubing is preferably manufactured from an electrically insulating material, communications conduits (wire pairs, fiber optic lines) can be incorporated into the sidewall of the tubing during manufacture. Such features enable drillers to send and receive real-time data and commands to and from the drilling apparatus, rather than rely on traditional forms of telemetry.

One drawback to systems of this type is that with the elimination of the conventional drilling rig and the complex directional movement of the composite coiled tubing drilling system, conventional casing strings are not easily deployed into a well created by such a system. Also, because the same apparatus is used to drill an entire well from start to finish, the telescoping casing technique is impractical. Furthermore, because the drilling apparatus may execute complex directional changes along its drillpath, conventional steel casing is not pliable enough to follow such a well contour. To prevent the loss of drilling and production fluids through formation leaching, a casing methodology applicable to wells drilled with composite coiled tubing drilling systems is highly desirable.

The present invention overcomes the deficiencies of the prior art.

BRIEF SUMMARY OF THE INVENTION

The deficiencies of the prior art are overcome using a method that includes delivering an expandable casing string to an uncased borehole coaxially upon a composite coiled tubing drilling string. Once drilling operations are complete in one portion of the borehole, pressure is supplied between the drill string and the coaxially mounted casing string so as to expand the casing string to the full gage of the borehole. Preferably, the outer surface of the casing string includes an adhesive agent that is designed to be activated by the expansion of the casing string against the borehole wall. Alternatively, the mechanical structure of the casing string itself may be configured to prevent the casing string from collapsing once it has been expanded. Once expanded, the casing string is left behind to isolate the well formation from drilling and production fluids that may subsequently flow through the wellbore.

These and other advantages of the present invention will become apparent on reading the detailed description of the invention in conjunction with the drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
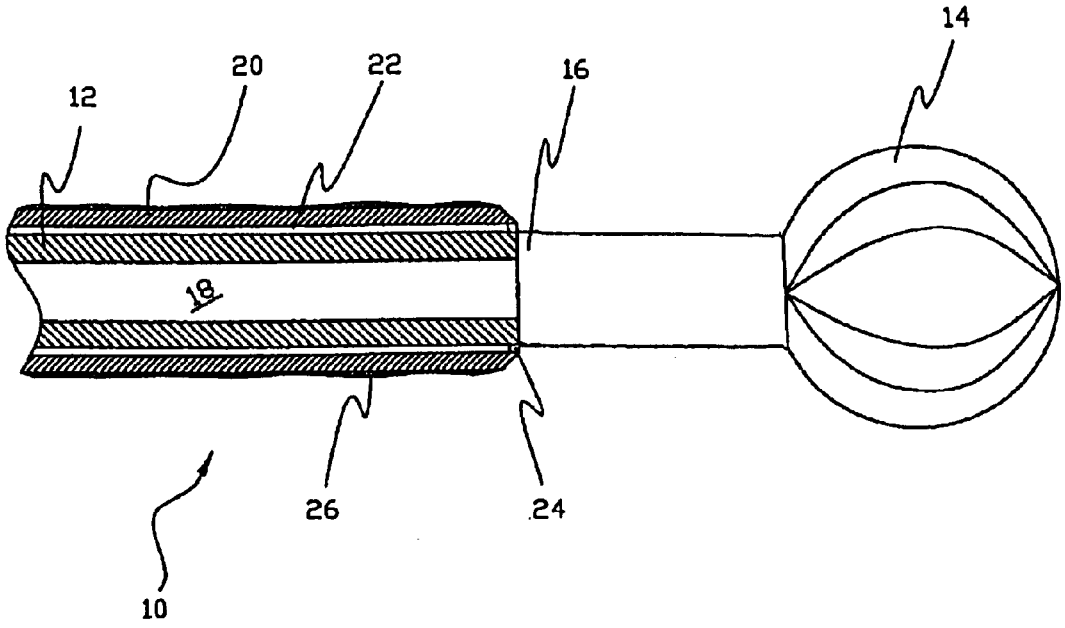
FIG. 1 is a schematic representation of a casing while drilling system constructed in accordance with a preferred embodiment of the present invention.

Referring initially to FIG. 1, a casing while drilling system 10 preferably includes a flexible drillstring 12, a drill bit 14, and an attachment and drive package 16.

Flexible drillstring 12 and attachment and drive package 16 are shown in a simplified schematic form. It is to be understood that drillstring 12 is preferred to exhibit the qualities of a composite coiled tubing system wherein drillstring 12 is constructed as a composite tubing with integral communications members. Likewise, it is to be understood that attachment and drive package 16 includes an axial and rotational drive system to thrust and rotate bit 14 within a borehole. For example, attachment and drive package 16 can comprise a bottom hole assembly (BHA), such as are well known in the art. The BHA preferably includes propulsion and steering equipment, including but not limited to a downhole motor and a bent sub.

Still referring to FIG. 1, flexible drillstring 12 includes a flowbore 18 and is surrounded by an expandable casing layer 20. Expandable outer layer 20 (shown in FIG. 1 in its contracted state) is preferably bonded to flexible drillstring 12 by a lightly adhesive layer 22 and is affixed to drillstring 12 at the bit end by an expandable anchor 24. Furthermore, a casing securing agent 26 is preferably applied to the outer diameter of the contracted casing layer 20.

Figure 2:
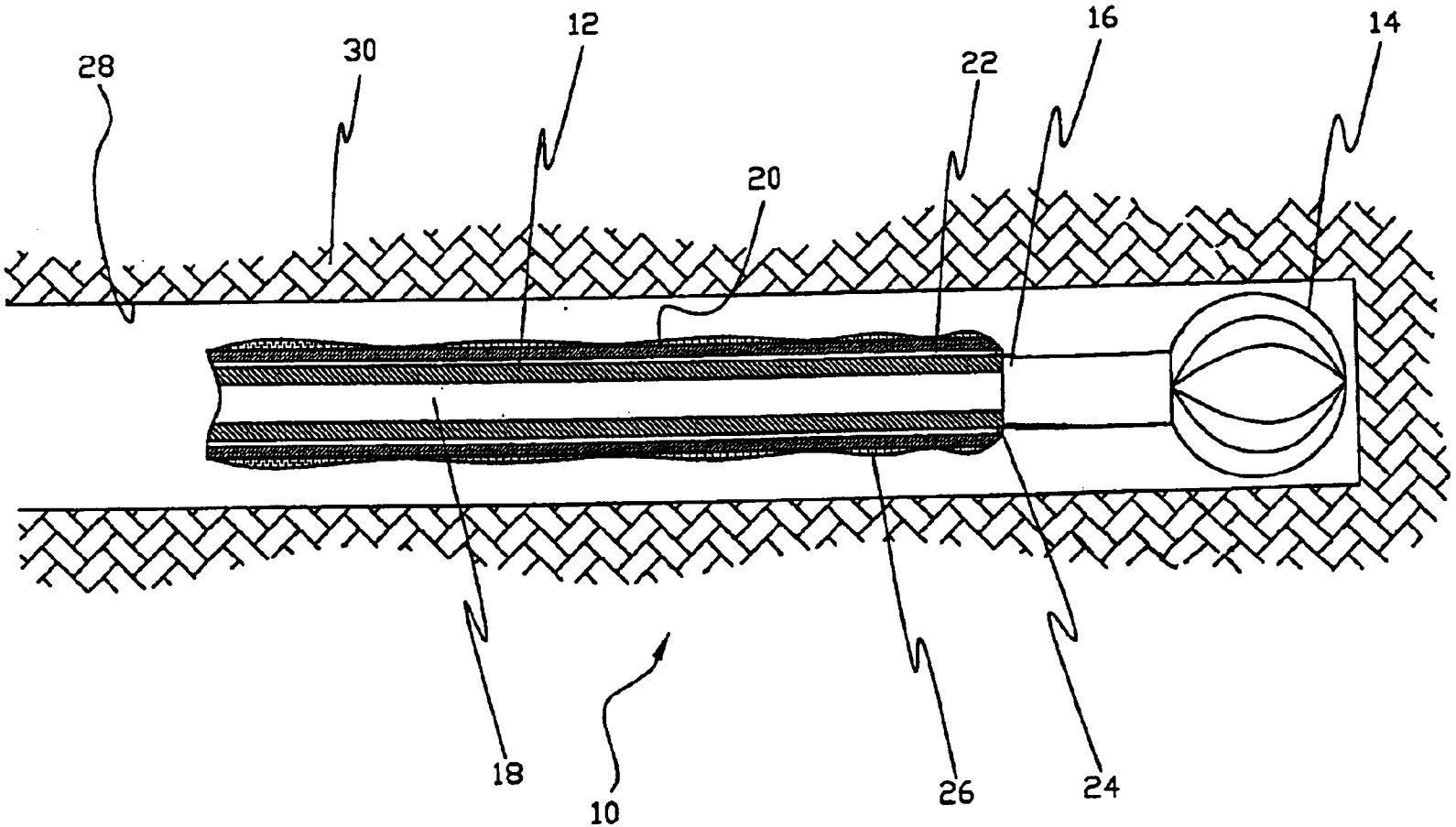
FIG. 2 is a schematic representation of the casing while drilling system of FIG. 1 being run in a borehole.

Referring now to FIG. 2, casing while drilling system 10 is shown being run in an uncased borehole 28 of formation 30. Attachment and drive package 16 preferably includes a tractor (not shown) to apply axial downhole force while a drive package (not shown) provides a rotational force to bit 14. The tractor preferably provides enough counter-rotational force such that drillstring 12 does not rotate as bit 14 rotates. Preventing rotation of drillstring 12 with respect to borehole 28 is preferred to prevent damage to the casing layer 20 or the adhesive agent 26.

Figure 3:
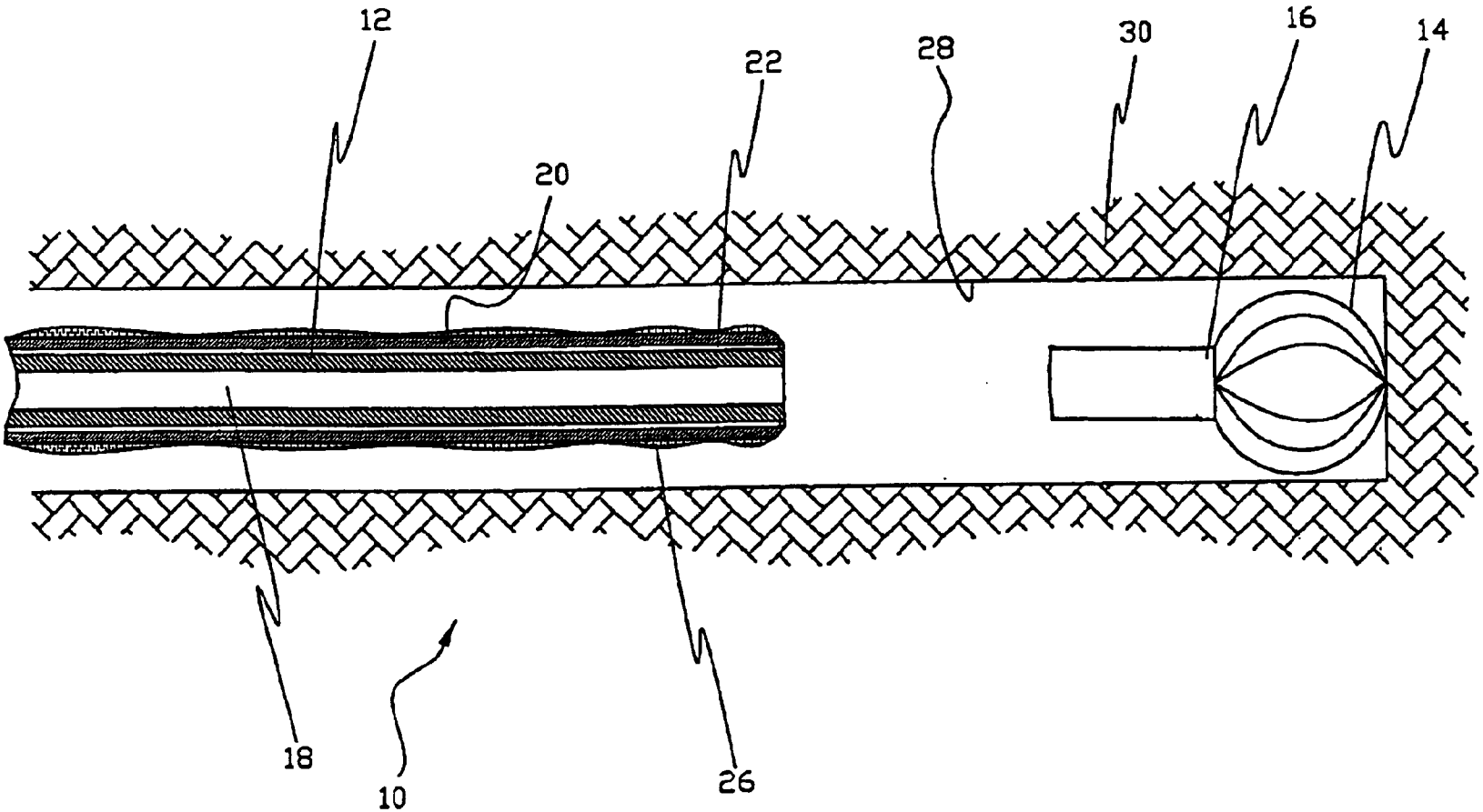
FIG. 3 is a schematic representation of the casing while drilling system of FIG. 1 being run in the borehole of FIG. 2 with the drill bit and drive assembly detached.

When casing of borehole 28 is desired, a signal is sent to attachment and drive package 16. With bit 14 detached, casing while drilling system 10 is retracted slightly as shown in FIG. 3 to allow room for the casing operation to be performed. Alternately, casing while drilling system 10 may be constructed so that casing operations may be carried out with bit 14 attached, although it may be preferable to detach bit 14 to allow casing while drilling system 10 room to actuate.

Figure 4:
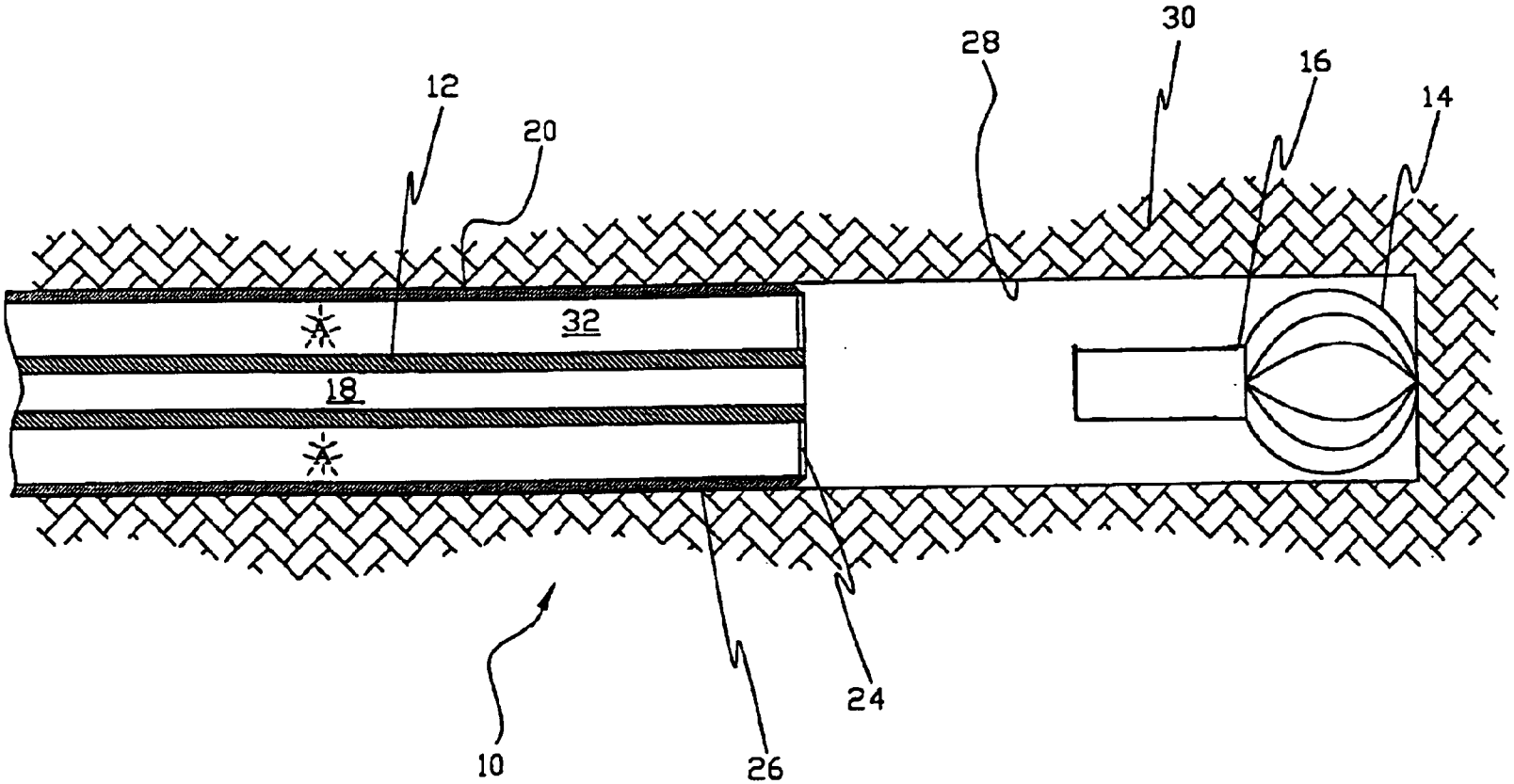
FIG. 4 is a schematic representation of the casing while drilling system of FIG. 3 with the casing string shown in activated form.

Referring now to FIG. 4, borehole 28 is cased when an activation event A occurs to overcome lightly adhesive layer 22 and expand casing 20 out to the borehole 28. With casing layer 22 expanded to borehole wall by event A, adhesive agent 26 is activated and securely bonds and seals casing layer 22 to borehole 28 wall.

Following casing of borehole 28, an annulus 32 is formed between casing 20 and drillstring 12, thus allowing drillstring 12 to operate and rotate independently of casing string 20. Afterward, attachment and drive package 16 may be re-coupled to drillstring 12 and either retracted to the surface or used to drill deeper into formation 30.

Figure 5:
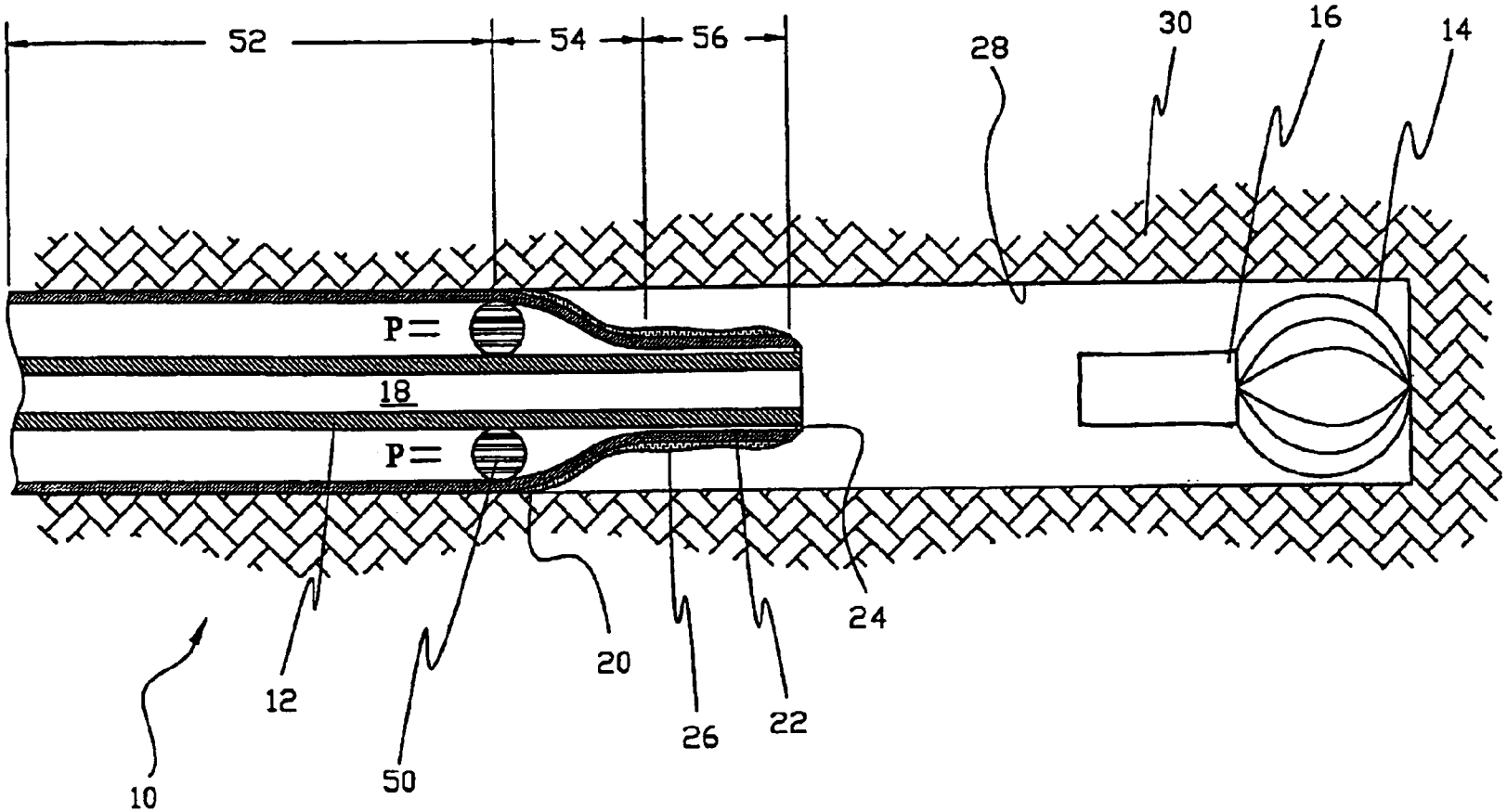
FIG. 5 is a schematic representation of the casing while drilling system of FIG. 3 shown during the activation of the casing string by a preferred means.

To accomplish the task of casing borehole 28, various methods and devices may be used by casing while drilling system 10 for activation event A, and many forms of adhesive structures may be employed for adhesive agent 26. Particularly, referring now to FIG. 5, a mandrel 50 may be employed to expand casing 20 fully to the borehole 28 throughout the length of drillstring 12 of apparatus 10. In using mandrel 50, operators at the surface prepare drillstring 12 for the delivery of mandrel 50 by cutting the tubing and stretching casing 20 away from drillstring 12 to allow mandrel 50 to be "started" along its path. Once started, hydrostatic pressure P is applied from the surface behind mandrel 50, effectively pushing mandrel 50 down the length of drillstring 12, breaking adhesive layer 22 and expanding casing 20 as mandrel 50 travels downhole. In FIG. 5, portion 52 is fully expanded, portion 54 is in the process of being expanded, and portion 56 is not yet expanded. The expansion of casing 20 away from drillstring 12 and against borehole 12 continues until mandrel 50 reaches expandable anchor 24. Once mandrel reaches anchor 24, an increase in pressure P can be generated to enable mandrel 50 to rupture anchor 24 and pass through, thereby allowing free flow of drilling and production fluids in the newly created annulus (32 from FIG. 4). An advantage of mandrel 50 is that its use allows a large contact pressure to be applied between casing 20 and borehole 28 through adhesive agent 26. One drawback to using mandrel 50 for activation event A is that it may not be completely effective in the event that a portion of the borehole 28 is significantly washed out or non uniform. In the event of such an occurrence, pressure P may wash around mandrel 50, thereby preventing it from traveling completely downhole.

The features and operation of activation event A can include a variety of different concepts. For example, the type of activation event A described in the preceding paragraph is a mechanical operation, inasmuch as the mandrel 50 applies a mechanical force to expand an expandable casing. Other types of activation events A that are contemplated herein include but are not limited to: thermal, pH, electronic, acoustic etc.

Figure 6:
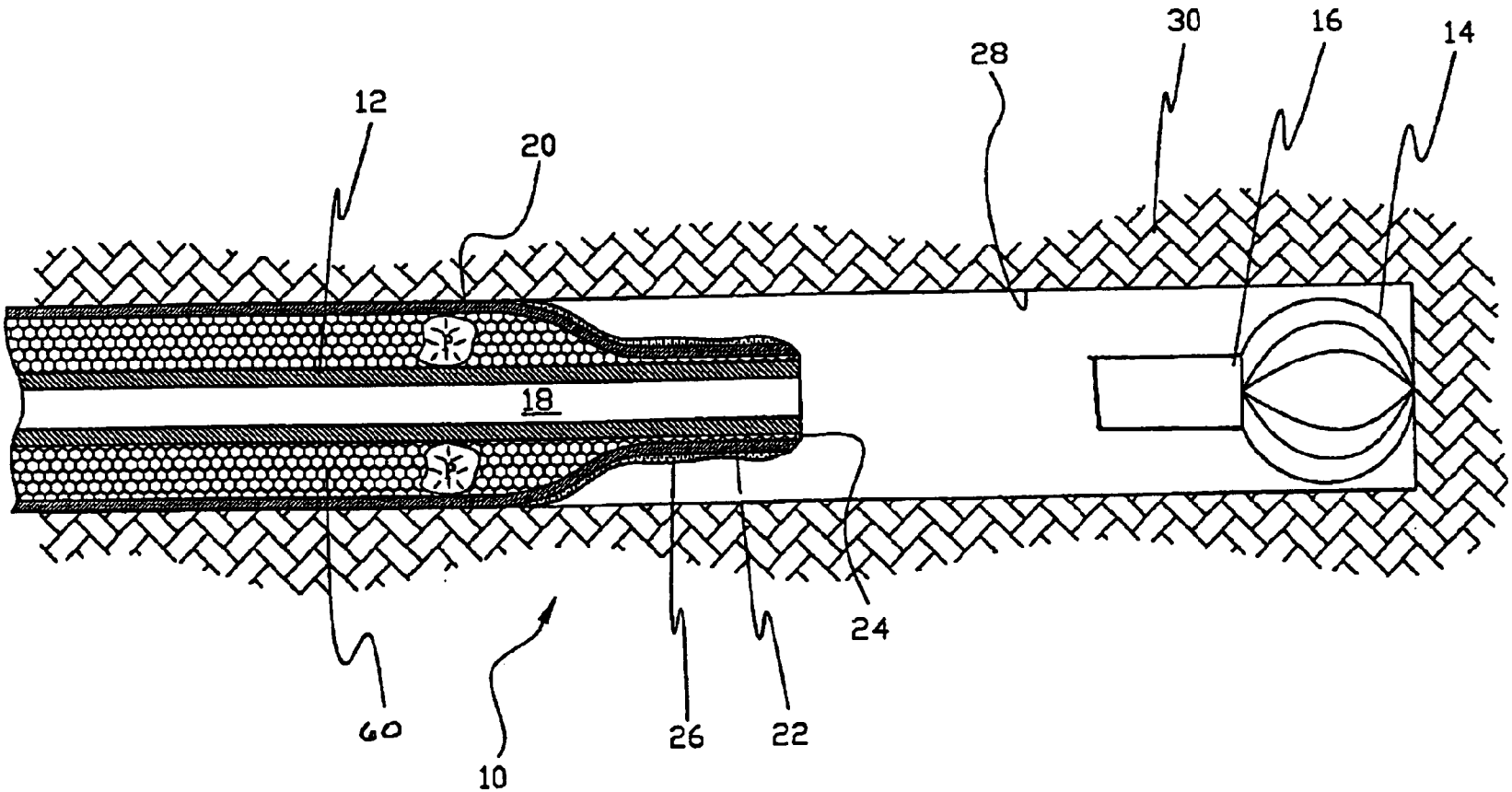
FIG. 6 is a schematic representation of the casing while drilling system of FIG. 3 shown during the activation of the casing string through a second preferred means.

Referring now to FIG. 6, an alternative means for expanding casing string 20 away from drillstring 12 is shown. In FIG. 6, casing string 20 is expanded away from drillstring 12 through the use of an expanding medium 60 between the compressed layers to overcome adhesive layer 22. Expanding medium 60 may take the form of any number of fluids but is preferably either drilling mud or water. By injecting fluid 60 between layers 12 and 20, casing 20 can be expanded completely within borehole 28 with little chance of failure, even if borehole 28 is washed out or otherwise non-uniform in cross section. In the event of a washed out portion of borehole 28, hydrostatic pressure P created by the injection of fluid 60 will allow casing 20 to expand farther outward than was possible with the fixed-diameter mandrel 50 of FIG. 5. In order for such a fluid injection arrangement to work properly, the hydrostatic pressure required to expand casing 20 and activate adhesive 26 must be lower than the pressure required to break the relatively weak adhesive layer 22. To accomplish this, the strength of adhesive layer 22 for the technique of FIG. 6 may have to be increased from the strength required in the expansion technique used in FIG. 5. If the strength of layer 22 is left weak, it may be possible for injected fluid 60 to separate casing 20 from the entire length of drillstring 12 prior to making proper adhesive contact with borehole wall 28.

It is further contemplated that two or more layers could be used in combination on a single length of tubing. In one embodiment, the layers are concentric, with one layer surrounding another. In this embodiment, the layers preferably have different constructions and different activation events, so that activation of the outermost layer does not result in the undesired activation of any of the inner layers. A multilayer expandable casing can be used to case successive portions of a borehole, or to provide multiple or overlapping casings in one or more portions of the borehole.

Once casing string 20 is expanded, it may be held in place by strong adhesive agent 26. Agent 26 can be any of several adhesives, but preferably is designed only to adhere to borehole 28 after casing 20 is expanded away from drillstring 12. To accomplish this, adhesive agent 26 may be constructed as a pressure, chemical, or temperature sensitive substance, requiring secondary activation to make a permanent bond. For example, agent 26 may be delivered as a binary adhesive, including an exposed resin with a hardener component contained in pressure sensitive capsules (not shown). When casing 20 is expanded against borehole 28, the expansion force ruptures the capsules, thereby mixing resin and hardener components to create an active adhesive. Alternatively, adhesive agent 26 may be constructed such that an elevated temperature, such as are typically found downhole, will activate the adhesive or rupture the hardener-containing capsules.

Additionally, adhesive agent 26 may also be constructed as a chemically or pH sensitive gel containing an emulsion of epoxy monomers. By being delivered in gel form, adhesive 26 can be adhered to the outside of collapsed casing string 20 throughout drilling. During drilling, if the gel were to become abraded, scraped, or otherwise removed in places, the pieces of the removed gel would be removed to the surface with the used drilling mud. Upon completion of drilling operations, the chemical makeup or pH of the circulating mud can be altered to activate the gel, thereby releasing the epoxy monomers and resulting in an epoxy coated casing 20 and stabilized wellbore 28.

Finally, casing string 20 may be constructed in such a fashion that its mechanical structure keeps it in place without the need for an adhesive agent. For example, components of casing string 20 may be designed such that once the structure is opened, it cannot be closed, as is with the case of a ratchet, for example. The "one way" structure of casing 20 may be on a microscopic or a macroscopic magnitude and mechanically prevents casing 20 from retracting once opened. Alternatively, casing string 20 may be delivered with an adhesive layer 26 attached thereupon that is activated by the expansion of casing string 20 from drillstring 12 to the borehole wall 28. An example of such a structure include microencapsulated adhesive materials that become adhesive upon being "stretched" by the expansion of casing string 20. Subsequent activation would further transform the adhered casing string 20 to give it desirable attributes such as increased tensile strength, hardness, and wear resistance.

Using the above described system, a borehole created with a composite coiled tubing drilling system can be effectively and efficiently cased to isolate the drilling and production fluids from the surrounding formation. Using the system described above, drilling and casing operations can be completed on a single trip into the wellbore, thereby saving the operating company time and cost. Furthermore, using the casing system of the present invention, numerous wells that would otherwise have to remain uncased, would be allowed some form of isolation from the formation throughout their depth.

In some embodiments, it is preferred that either or both of attachment and drive package 16 and bit 14 have an outside diameter that is smaller than the inside diameter of the expanded casing so that the BHA and/or the bit can be pulled up out of the well after it has been cased. In instances where this is desired, either the BHA or the bit, or both, are mounted on the drillstring 12 by means of a releasable collar.

The above discussion is meant to be illustrative of the principles of the present invention. Numerous variations and modifications will become apparent to those skilled in the art once the above disclosure is fully appreciated. It is intended that the following claims be interpreted to embrace all such variations and modifications.

What is claimed is:

1. A method for casing a borehole, the method comprising:

a) delivering an expandable casing to an uncased borehole coaxially upon a drillstring; and b) expanding the expandable casing such that it engages the borehole wall wherein step b) includes pressurizing fluid between the expandable casing and the drillstring.

2. A method for casing a borehole, the method comprising:

a) delivering an expandable casing to an uncased borehole coaxially upon a drillstring; and b) expanding the expandable casing such that it engages the borehole wall wherein step b) includes pressurizing fluid between the expandable casing and the drillstring and wherein a mandrel is used in conjunction with the pressurized fluid to effectively expand the expandable casing against the borehole wall.

3. A The method of claim 2 wherein the mandrel is run from the surface to the bottom of the borehole between the expandable casing and the drillstring.

4. A method for casing a borehole, the method comprising:

delivering a casing string with an adhesive agent upon its outer diameter to an uncased borehole coaxially upon a drillstring;

activating the casing string with an activation event, the activation event forcing the casing string upon the borehole wall, thereby creating a cased borehole; the activation event including pressurizing fluid from the surface between the casing string and the drillstring, such that the adhesive agent creates a bond between the casing string and the borehole.

5. The method of claim 4 wherein the adhesive agent is pressure sensitive.

6. The method of claim 5 wherein the mandrel activates the pressure sensitive adhesive as the mandrel travels downhole from the surface.

7. The drillstring according to claim 4 further including at least a second radially expandable layer, wherein said first and second radially expandable layers are each expandable in response to an activation event and said activation events for said first and second radially expandable layers are different.

8. A method for casing a borehole, the method comprising:

a) delivering an expandable casing to an uncased borehole coaxially upon a drillstring; and b) expanding the expandable casing such that it engages the borehole wall wherein step b) includes pressurizing fluid between the expandable casing and the drillstring and wherein a mandrel is used in conjunction with the pressurized fluid to effectively compress the casing string against the borehole wall as the mandrel travels downhole from the surface.

9. The drillstring according to claim 8, further including at least a second radially expandable layer, wherein said first and second radially expandable layers are each expandable in response to an activation event and said activation events for said first and second radially expandable layers are different.

* * * * *